US009129768B2

(12) United States Patent
Dahl et al.

(10) Patent No.: US 9,129,768 B2
(45) Date of Patent: Sep. 8, 2015

(54) MULTIPOLE ELECTRICAL SWITCHING DEVICE

(75) Inventors: Jörg-Uwe Dahl, Werder (DE); Ludvik Godesa, Berlin (DE); Andreas Hierl, Schmidgaden (DE); Siegfried Pirker, Ensdorf (DE); Thomas Pniok, Hamburg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 143 days.

(21) Appl. No.: 13/500,977

(22) PCT Filed: Oct. 15, 2010

(86) PCT No.: PCT/EP2010/065568

§ 371 (c)(1),
(2), (4) Date: Apr. 9, 2012

(87) PCT Pub. No.: WO2011/045428

PCT Pub. Date: Apr. 21, 2011

(65) Prior Publication Data

US 2012/0199452 A1 Aug. 9, 2012

(30) Foreign Application Priority Data

Oct. 15, 2009 (DE) ..... 10 2009 050 296
Apr. 1, 2010 (DE) ..... 10 2010 014 428

(51) Int. Cl.
*H01H 19/10* (2006.01)
*H01H 71/10* (2006.01)
(Continued)

(52) U.S. Cl.
CPC ..... *H01H 71/1009* (2013.01); *H01H 1/2058* (2013.01); *H01H 19/64* (2013.01); *H01H 73/045* (2013.01); *H01H 2009/0094* (2013.01)

(58) Field of Classification Search
CPC . H01H 73/045; H01H 19/64; H01H 71/1045; H01H 71/1009
USPC ..... 200/11 R, 50.32, 303, 5 R, 9
See application file for complete search history.

(56) References Cited

U.S. PATENT DOCUMENTS 5,281,776 A 1/1994 Morel et al.
6,259,338 B1 * 7/2001 Boeder et al. ..... 335/6
(Continued)

FOREIGN PATENT DOCUMENTS

CN 1602534 A 3/2005
CN 1910716 A 2/2007
(Continued)

OTHER PUBLICATIONS

English translation of EP 2099044 to Schneider, Sep. 9, 2009.*
(Continued)

*Primary Examiner* — Felix O Figueroa
(74) *Attorney, Agent, or Firm* — Harness, Dickey & Pierce, P.L.C.

(57) ABSTRACT

A switching device include at least two switching poles. Each of the switching poles has one current path and one switching contact system for opening and closing the current path, wherein a movable contact arrangement of the switching contact system of the switching poles has an integral switching shaft segment, formed from insulating material, which bears a contact lever arrangement and in which the switching shaft segments of adjacent switching poles are connected by way of at least two connecting branches; so as to form the switching shaft. The connecting branches extending at a distance parallel to the axis of rotation and are formed from corresponding connecting elements. In at least one embodiment, all of the connection elements of the at least two connecting branches are formed by first sections of the integral switching shaft segments, which bear the contact lever arrangements.

15 Claims, 7 Drawing Sheets

(51) Int. Cl.

| | |
|---|---|
| ***H01H 73/04*** | (2006.01) |
| ***H01H 19/64*** | (2006.01) |
| ***H01H 1/20*** | (2006.01) |
| *H01H 9/00* | (2006.01) |

(56) References Cited

U.S. PATENT DOCUMENTS

| | | | | |
|---|---|---|---|---|
| 7,116,194 | B2 * | 10/2006 | Azzola et al. | 335/202 |
| 7,538,644 | B2 * | 5/2009 | Oh | 335/8 |
| 7,541,899 | B2 * | 6/2009 | Ahn | 335/8 |
| 7,679,018 | B2 * | 3/2010 | Kolmonen et al. | 200/564 |
| 7,863,530 | B2 * | 1/2011 | Mattlar et al. | 200/50.32 |
| 8,319,131 | B2 * | 11/2012 | Chen et al. | 200/337 |
| 8,513,550 | B2 * | 8/2013 | Chen | 200/11 R |
| 2004/0256207 | A1 | 12/2004 | Azzola et al. | |
| 2005/0068131 | A1 | 3/2005 | Azzola et al. | |
| 2006/0152308 | A1 | 7/2006 | Rajauria et al. | |

FOREIGN PATENT DOCUMENTS

| | | | |
|---|---|---|---|
| CN | 1326175 | C | 7/2007 |
| CN | 100541697 | C | 9/2009 |
| CN | 101556870 | A | 10/2009 |
| DE | 199 10 032 | | 4/2000 |
| EP | 0 542 636 | | 5/1993 |
| EP | 2099044 | A2 | 9/2009 |
| FR | 2891661 | A1 | 4/2007 |
| WO | WO 03050835 | A1 | 6/2003 |
| WO | WO 2005069324 | A1 | 7/2005 |

OTHER PUBLICATIONS

Chinese Office Action dated Feb. 11, 2014 for corresponding Chinese Application No. 201080046387.4.
Chinese Office Action dated Sep. 3, 2014 for corresponding Chinese Application No. 201080046387.4.
International Search Report (PCT/ISA/210), 2010.

* cited by examiner

MULTIPOLE ELECTRICAL SWITCHING DEVICE

PRIORITY STATEMENT

This application is the national phase under 35 U.S.C. §371 of PCT International Application No. PCT/EP2010/065568 which has an International filing date of Oct. 15, 2010, which designates the United States of America, and which claims priority on German patent application numbers DE 10 2009 050 296.3 filed Oct. 15, 2009 and DE 10 2010 014 428.2 filed Apr. 1, 2010, the entire contents of each of which are hereby incorporated herein by reference.

FIELD

At least one embodiment of the invention generally relates to a multipole electrical switching device with at least two switching poles, with a drive mechanism and with a switching shaft which is capable of rotating under the action of the drive mechanism about an axis of rotation formed by pivot bearings. In at least one embodiment, each of the switching poles has in each case one current path and one switching contact system for opening and closing the current path, it being possible for a movable contact arrangement of the switching contact system of each of the switching poles to have in each case an integral switching shaft segment which is formed from insulating material, which carries a contact lever arrangement and in which the switching shaft segments of adjacent switching poles are connected in each case to form the switching shaft.

In at least one embodiment, these switching devices are used to interrupt the individual phases of a multiphase main circuit, it being possible for the parts of the switching device which are assigned to one phase of the mains circuit to form in each case one of the switching poles of the multipole switching device. Here the torsionally-rigid connection of the integral switching shaft segments to the switching shaft is necessary to enable the switching contact systems of all poles to be operated jointly by way of the drive mechanism.

BACKGROUND

Embodiments of generic multipole switching devices are known from patent specifications EP 0 542 636 B1; EP 1 454 331 B1 and DE 199 10 032 C1.

In the case of the switching device known from EP 0 542 636 B1, the switching shaft segments of adjacent switching poles are connected in each case by way of at least two connecting branches so as to form the switching shaft, the connecting branches extending in each case at a distance parallel to the axis of rotation. Here the two connecting branches are formed from corresponding connecting elements in the form of separate connecting links and corresponding openings of the switching shaft segments.

SUMMARY

Based on a multipole electrical switching device, the inventors have discovered that it is desireable to ensure connection of the switching shaft elements with as precise a fit as possible, in which the modularity of the individual switching poles is retained and complicated assembly operations are avoided.

According to at least one embodiment of the invention, all connecting elements of the at least two connecting branches are formed by first sections of the integral switching shaft segments which carry the contact lever arrangements.

BRIEF DESCRIPTION OF THE DRAWINGS

An inventive multipole electrical switching device of an embodiment is illustrated in FIGS. 1 to 9; in which.

DETAILED DESCRIPTION OF THE EXAMPLE EMBODIMENTS

In at least one embodiment of the inventive, multipole electrical switch no separate, physically independent connecting elements are therefore required for connecting the switching shaft segments, so that the number of tolerance-critical parts of the switching shaft is limited to the switching shaft segments which carry the contact lever arrangements, and therefore the play of the switching shaft segments which also has a negative effect on the switching capacity of the switching device, is reduced to a minimum.

Advantageously, due to the elimination of separate connecting elements, the assembly and mounting of the separate switching shaft segments is easy to implement.

In an example embodiment of the inventive multipole electrical switching device, provision is made for the corresponding connecting elements to be formed as male-female type pairs.

The degree of play between the drive mechanism and the switching shaft can be kept small if bearings are formed from second sections of the integral switching shaft segments for the drive mechanism at the coupling elements coupled to the switching shaft, it being possible for the second sections to be formed as lugs which extend transversely to the axis of rotation of the switching shaft.

In multipole electrical switching devices in which, in each case, separate switching pole housings are assembled from two half shells, and in each case form an insulating enclosure of a switching chamber for accommodating in each case an individual switching pole, pairs of corresponding bearing devices can form the pivot bearings. At the same time it is technically simple if the first of the bearing device(s) is formed by third sections of the integral switching shaft segments and the second of the bearing device(s) assigned to the first bearing device(s) are formed by sections of the half shells.

Preferably, for the engagement of the connecting elements, provision is made for the half shells to have openings in the form of curved elongated slots which extend along the motion path of the connecting elements. The separate switching pole housings can be accommodated in an enclosure.

Figure 1:
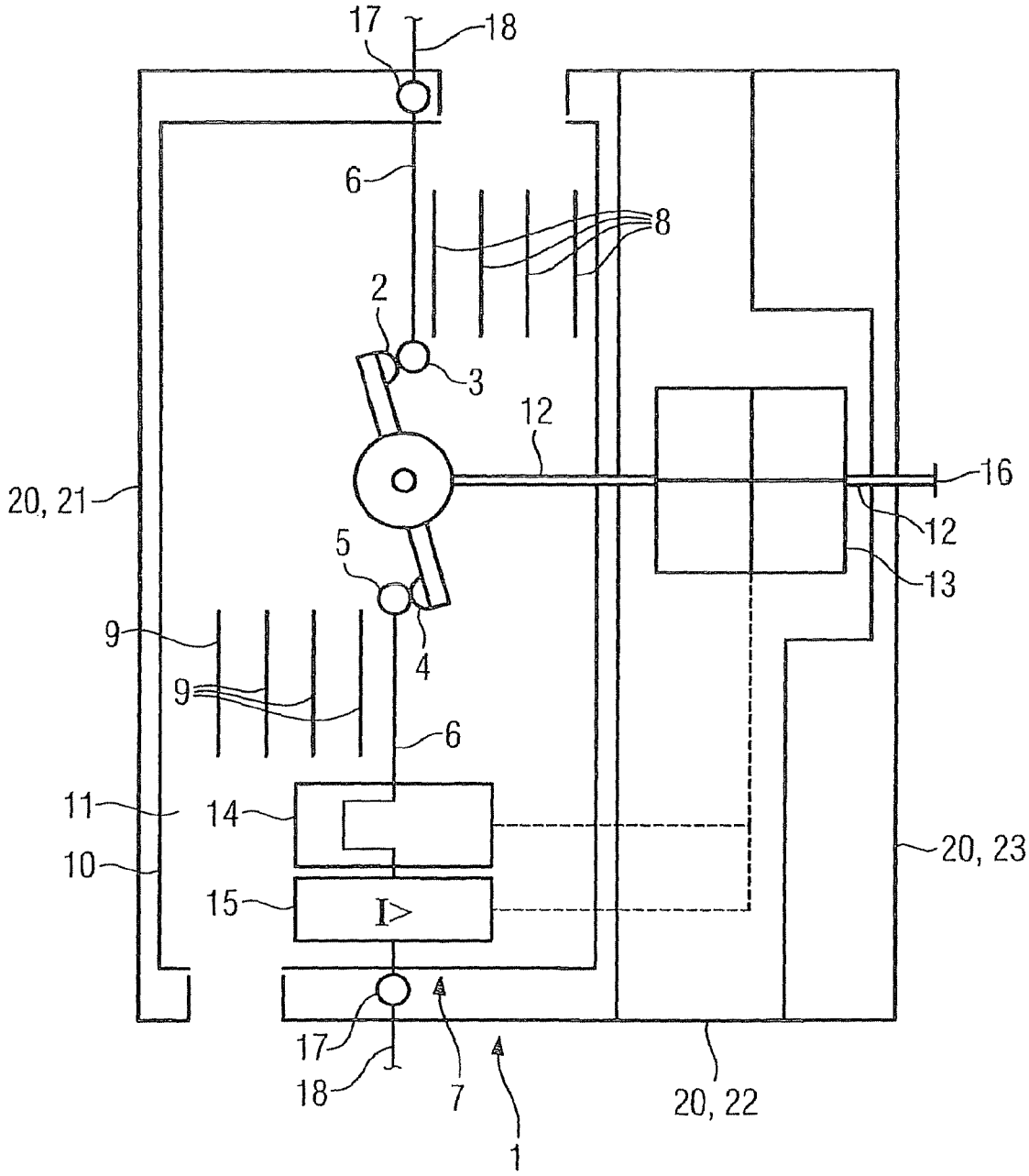
FIG. 1 shows a schematic representation of an embodiment of the inventive multipole electrical switching device in a section through its switching pole, with a drive mechanism and with a switching shaft which is capable of rotating under the action of the drive mechanism.

According to the basic diagrammatic representation of an embodiment of the inventive multipole electrical switching device 1 shown in FIG. 1, this switching device contains switching elements in the form of switching contacts 2, 3, 4, 5 for dual interruption of a first current path 6 of a first switching pole 7. The current path 6 is part of a first main circuit of a power distribution network, in particular a low-voltage network. A first arc splitter element is allocated to the switch contacts 2, 3 and a second arc splitter element is allocated to the switch contacts 4, 5, it being possible for arc splitter elements to be constructed as stacked quenching plates 8, 9.

The electrical switching device 1 has a first switching chamber 11 for accommodating the contacts 2, 3; 4, 5 of the first switching pole 7, the first switching chamber being delimited by a first switching pole housing 10. Drive elements which form a drive mechanism 12 of the electrical switching device serve to open and close the switching contacts 2, 3; 4, 5.

Moreover, the electrical switching device has a disconnecting mechanism 13 in the form of a breaker latching mechanism. The breaker latching mechanism is arranged as an intermediate mechanical element between the switching elements and the drive elements in line with the drive mechanism 12.

Tripping elements are provided in the electrical switching device 1, which act to release the latching of the disconnecting mechanism—that is to say to release the breaker latching mechanism—in order to actuate the drive mechanism 12 to open the switching contacts 2, 3; 4, 5. In particular, a thermal trip 14 (as overload detection element), an electromagnetic trip 15 (as short-circuit detection element) and a manual trip 16 projecting at the front out of the insulating cover, are provided, by which the breaker latching mechanism can be released to open the switching contacts. However, a pressure trip (as a short-circuit detection element) or an electronic trip (as an overload and/or short-circuit detection element) can also be provided.

The electrical switching device has further switching chambers parallel to the first switching chamber 11 shown in FIG. 1. In each case the additional switching chambers are bounded by further separate switching pole housings. Switching contacts of additional switching poles are arranged in the additional switching chambers. In each case the ends of the current path 6 of each of the switching poles 7 are electrically connected by way of line terminals 17 to at least one electrical conductor 18 of the respective main circuit of the power distribution network. The separate switching pole housings 10 are arranged between a first part 21 constructed as a base and a second part 22 of an enclosure 20 constructed as an intermediate cover. The third part 23 of the enclosure which forms the insulating cover is used in the usual way to cover accessories, not shown here, which are arranged in the locating compartment of the intermediate cover.

Figure 2:
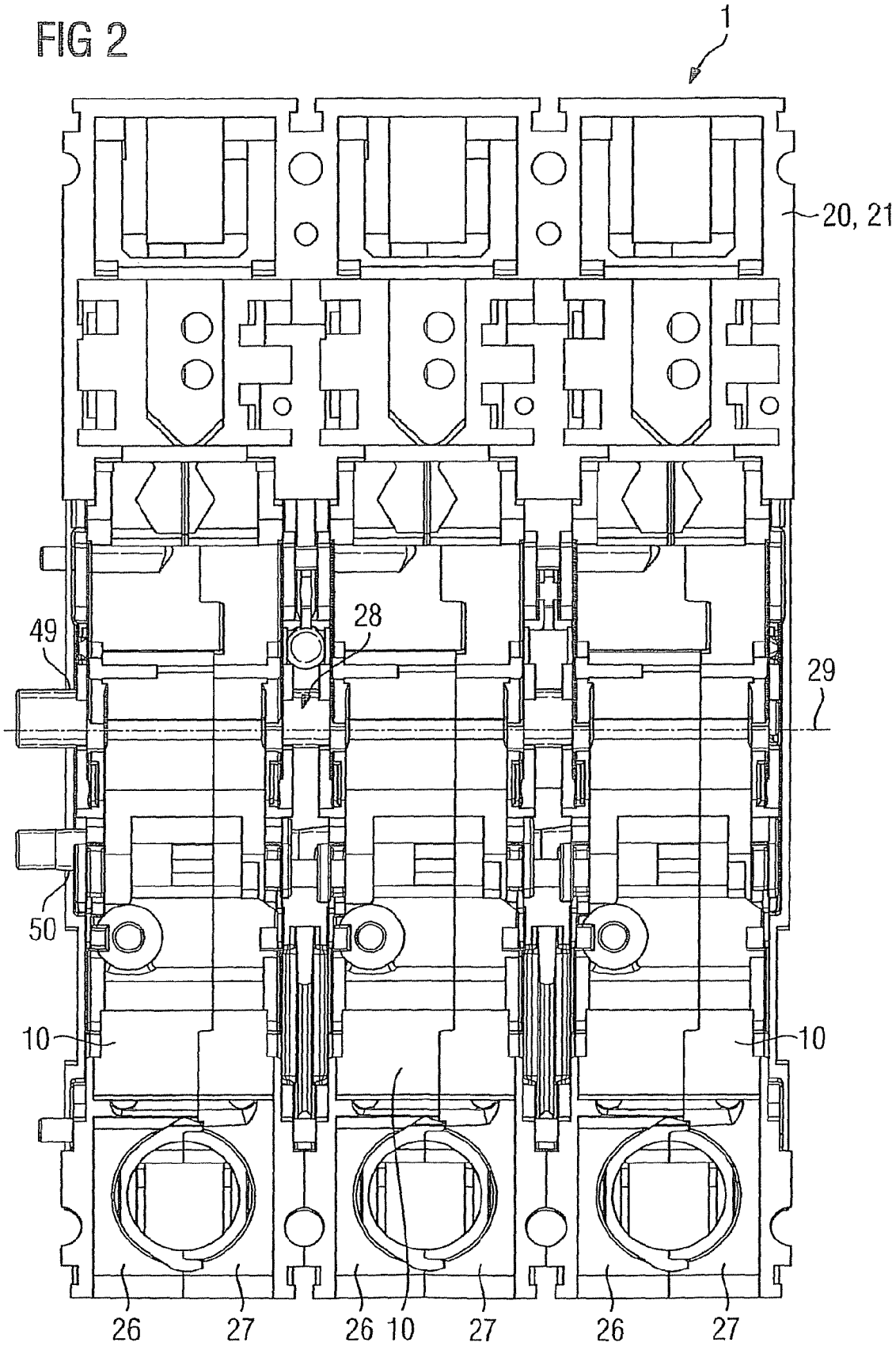
FIG. 2 shows an embodiment of the inventive switching device with three switching poles arranged in an enclosure and three switching shaft segments supported in a rotatable manner in separate switching pole housings which—being interconnected—form the switching shaft shown in FIG. 1.

According to FIG. 2, an embodiment of the inventive multipole electrical switching device 1 is constructed as a three-pole low-voltage circuit-breaker in the form of a compact switch having a "cassette" type of construction. It therefore has three switching poles, each of which is accommodated in one of the separate switching pole housings 10. Each of the three switching pole housings 10 consists of two half shells 26, 27 and forms an insulating enclosure for one of the switching chambers 11 (see FIG. 1), in which one of the three respective switching poles is located. Also shown here is a switching shaft 28 which, under the action of the drive mechanism 12 shown in FIG. 1, is rotatable about an axis of rotation 29, and the first part 21 of the enclosure 20 in which the separate switching pole housings 10 are accommodated.

Figure 4:
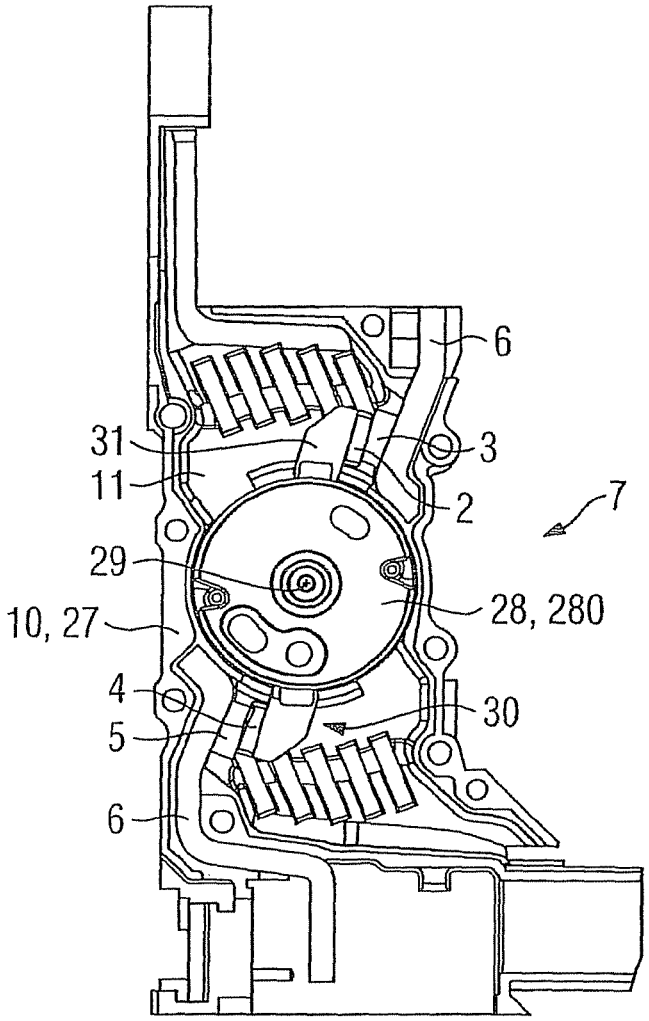

According to FIG. 4, a switching contact system residing in this case of a stationary contact arrangement and a moving contact arrangement, is utilized to open and close the current path 6 of each of the switching poles 7. Each moving contact arrangement of the switching poles 7 has an integral switching shaft segment 280 made of insulating material, which carries a contact lever arrangement denoted as a whole by 30. Here a contact lever 31 formed as a double lever is supported in a rotatable manner in the switching shaft segment 280 and extends transversely to the axis of rotation 29 of the switching shaft segment 280 (of the switching shaft 28). The two ends of the contact lever 31 project from the switching shaft segment 280. At their ends, on one side of the external contour, they each carry contacts which face away from each other and form the switching contacts 2 and 4 of the switching device (of the circuit-breaker).

Figure 5:
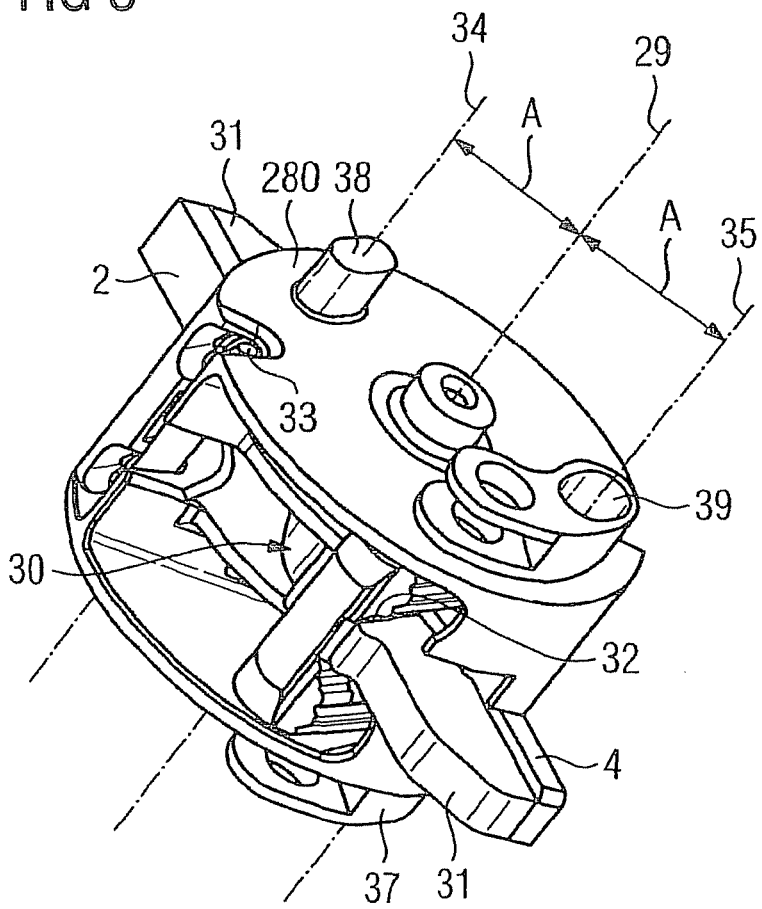
FIG. 5 shows one of the switching shaft segments with a contact lever arrangement contained therein.

The contact lever 31 in FIGS. 4 and 5 is shown in its ON position in which its two contacts make contact with opposing stationary contacts of the stationary contact arrangement, which form the stationary switching contacts 3 and 5. A recess 32 in which a bolt 33 is inserted so as to run parallel to the axis of rotation 29 of the switch segment 280, is provided in each case on the sides of the external contour of the contact lever 31 opposite to the contacts. Springs engaging with both ends of the bolt apply torque to the contact lever 31 in the closing direction (that is to say in its ON position). The other ends of the springs are attached to the switching shaft segment 280 via additional bolts.

The switching shaft segments 280 of adjacent switching poles 7 are connected in each case by way of two connecting branches 34, 35, each extending at a distance A parallel to the axis of rotation 29 and formed from corresponding connecting elements 36, 37, 38, 39.

All connecting elements 36, 37, 38, 39 of the two connecting branches 34, 35 are formed by first sections of the integral switching shaft segments 280 which carry the contact lever arrangements 30.

According to FIGS. 6 to 9, corresponding connecting elements 36, 38; 37, 39 form male-female type pairs. The first 36 and second 38 of the connecting elements therefore form male-female type pairs and the third 37 and fourth 39 connecting elements form the second male-female type pairs. In this case all three switching shaft segments 280 are of identical construction since a first outer side of the switching shaft segment 280 is provided with one of the first 36 and one of the second 37 connecting elements and the outer side opposite to it is provided with one of the third 38 and one of the fourth 39 connecting elements.

Figure 6:
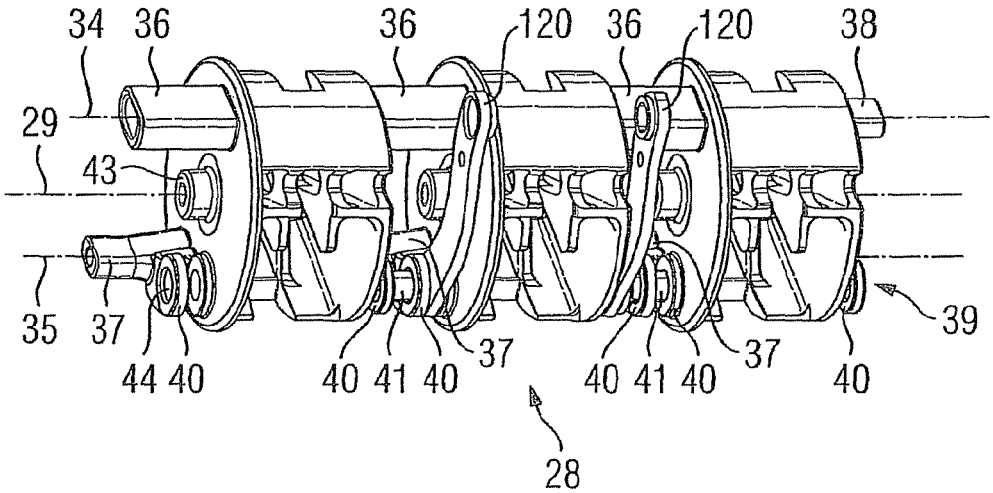
FIGS. 6 to 9 show two views of the switching shaft before and after the joining of its switching shaft segments, respectively.
Figure 7:
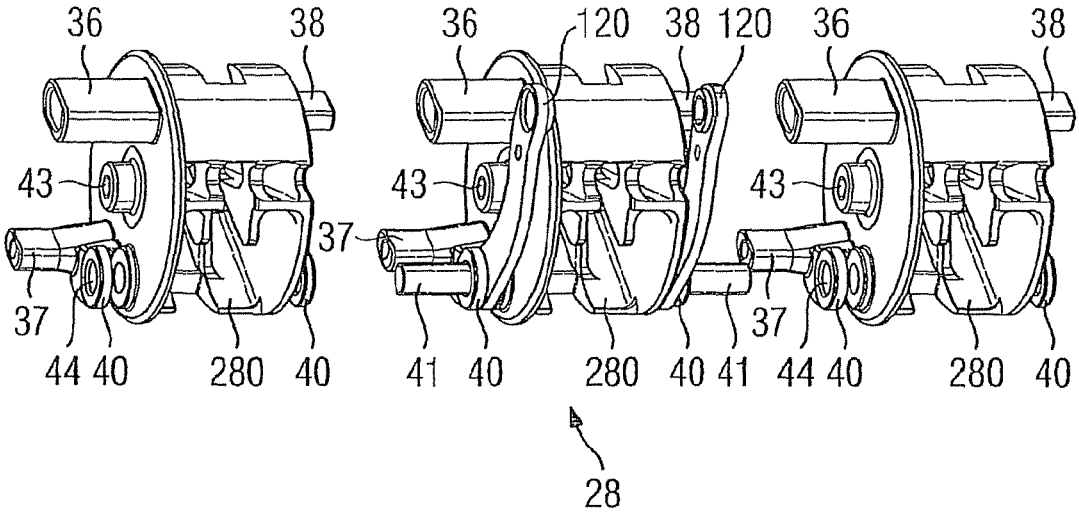
Figure 8:
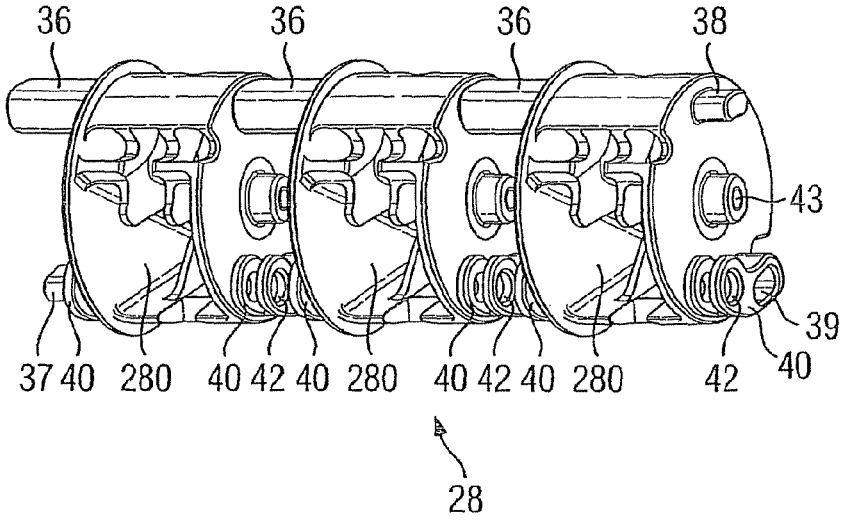
Figure 9:
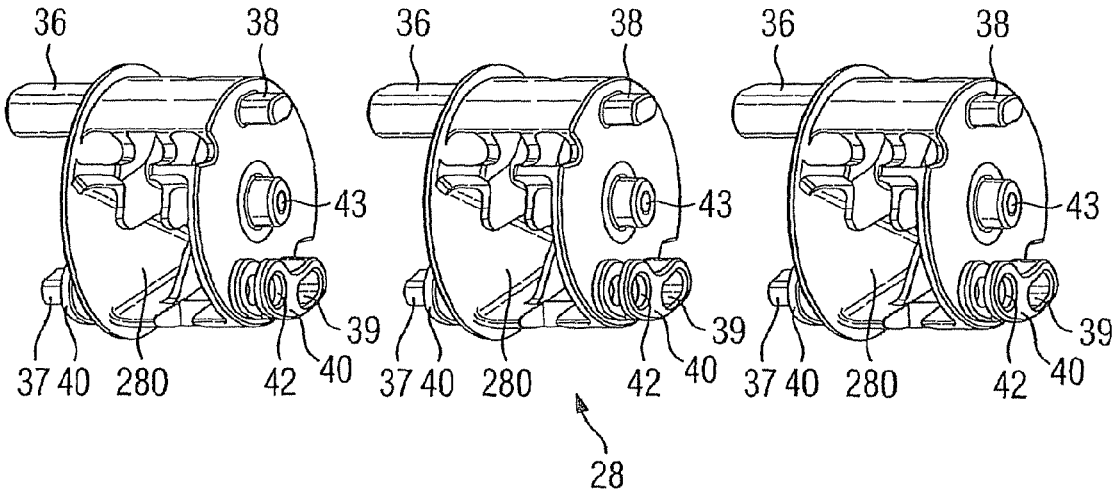

FIGS. 6 and 7 also show that thrust bearings 40 for the drive mechanism are constructed from second sections of the integral switch shaft segments 280 at the coupling elements 41 coupled to the switching shaft 28. These thrust bearings 40 are in the form of lugs which extend transversely to the axis of rotation 29 of the switching shaft 28. The lugs have through-holes 42 which are penetrated by the ends of the coupling elements 41 which are constructed as coupling bolts. Furthermore, the coupling bolts pass through parallel drive levers 20 which form an end element of the drive mechanism 12 which is coupled to the switching shaft 28.

Figure 3:
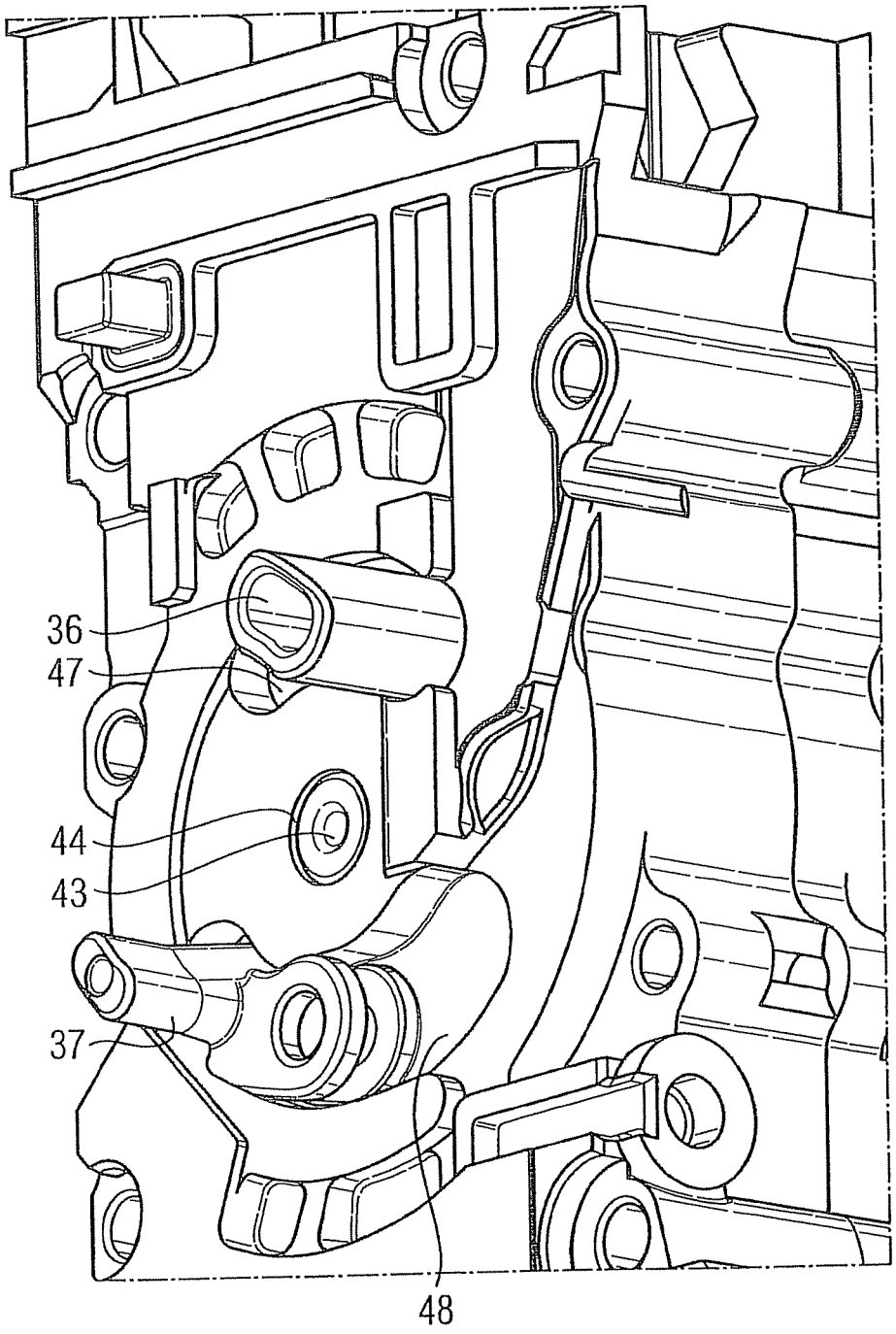
FIGS. 3 and 4 show two views of one of the switching poles shown in FIG. 2.

Pairs of corresponding bearing devices 43, 44 are used as a pivot bearing which forms the axis of rotation 29. According to FIG. 3, the first 43 of the bearing devices are formed from three sections of the integral switching segments and the second 44 of the bearing devices from sections of the half shells 26, 27.

For engagement with the connecting elements 36, 37, 38, 39, the half shells 26, 27 have openings (of which only two 47, 48 can be seen in the figures) which are constructed as curved elongated slots which extend along the motion path of the connecting elements 36, 37, 38, 39. For coupling to an external drive, two 36, 37 of the longer connecting elements engage with openings 49, 50 of the enclosure 20 (see FIG. 2), it being possible for these openings 49, 50 to be constructed as curved elongated slots which extend along the motion path of the connecting elements 36, 38.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A multipole electrical switching device including at least two switching poles, the multipole electrical switching device comprising:

a drive mechanism; and a switching shaft, capable of rotating under action of the drive mechanism about an axis of rotation formed by pivot bearings, each of the switching poles including one current path and one switching contact system for opening and closing the current path, a movable contact arrangement of the switching contact system of each of the switching poles including an integral switching shaft segment formed from insulating material, the switching shaft segment including a contact lever arrangement, the switching shaft segment of each of the switching poles being connectable to an adjacent one of the switching poles by way of at least two connecting branches so as to form the switching shaft, the at least two connecting branches each extending at a distance parallel to the axis of rotation, and the at least two connecting branches of each of the switching poles including first and second connecting elements protruding in a same direction beyond an outer surface of the switching shaft segment such that for a first switching pole and a second switching pole in the switching poles, a first connecting element of the first switching pole includes a male-type connector engaging with a corresponding female-type connector of the second switching pole, and a second connecting element of the first switching pole includes a female-type connector engaging with a corresponding male-type connector of the second switching pole, wherein the corresponding female-type connector and the corresponding male-type connector protrude beyond an outer surface of the switching shaft segment of the second switching pole.

2. The multipole electrical switching device of claim 1, wherein the first and second connecting elements protrude a substantially same distance beyond the outer surface.

3. The multipole electrical switching device of claim 1, wherein thrust bearings for the drive mechanism are formed by second sections of the switching shaft segments at coupling elements coupled to the switching shaft.

4. The multipole electrical switching device of claim 3, wherein the thrust bearings are formed as lugs which extend transversely to the axis of rotation of the switching shaft.

5. The multipole electrical switching device of claim 1, wherein separate switching pole housings, which in each case include two half shells, and which in each case form an insulating cover for a switching chamber to accommodate in each case one individual of the at least two switching poles and wherein pairs of corresponding bearing devices form the pivot bearings, a first of the bearing devices being formed by third sections of the integral switching shaft segments and a second of the bearing devices being formed by sections of the half shells.

6. The multipole electrical switching device of claim 5, wherein, for engagement with the first and second connecting elements, the half shells include openings which are constructed as curved elongated slots which extend along the motion path of the first and second connecting elements.

7. The multipole electrical switching device of claim 5, wherein the separate switching pole housings are accommodated in an enclosure.

8. The multipole electrical switching device of claim 2, wherein thrust bearings for the drive mechanism are formed by second sections of the integral switching shaft segments at coupling elements coupled to the switching shaft.

9. The multipole electrical switching device of claim 8, wherein the thrust bearings are formed as lugs which extend transversely to the axis of rotation of the switching shaft.

10. The multipole electrical switching device of claim 6, wherein the separate switching pole housings are accommodated in an enclosure.

11. The multipole electrical switching device of claim 2, wherein separate switching pole housings, which in each case include two half shells, and which in each case form an insulating cover for a switching chamber to accommodate in each case one individual of the at least two switching poles and wherein pairs of corresponding bearing devices form the pivot bearings, a first of the bearing devices being formed by third sections of the integral switching shaft segments and a second of the bearing devices being formed by sections of the half shells.

12. The multipole electrical switching device of claim 11, wherein, for engagement with the first and second connecting elements, the half shells include openings which are constructed as curved elongated slots which extend along the motion path of the first and second connecting elements.

13. The multipole electrical switching device of claim 11, wherein the separate switching pole housings are accommodated in an enclosure.

14. The multipole electrical switching device of claim 12, wherein the separate switching pole housings are accommodated in an enclosure.

15. The multipole electrical switching device of claim 1, wherein the first and second connecting elements are located on opposing edges of the switching shaft segment.

* * * * *